United States Patent [19]

Zimmerman

[11] 4,298,294

[45] Nov. 3, 1981

[54] BASEMENT DEWATERING SYSTEM

[76] Inventor: C. Lyle Zimmerman, R.R. #1, West Liberty, Iowa 52776

[21] Appl. No.: 23,543

[22] Filed: Mar. 26, 1979

[51] Int. Cl.[3] ..... E02D 31/02

[52] U.S. Cl. ..... 405/37; 52/169.5

[58] Field of Search ..... 405/36, 37, 38, 50, 405/229; 52/169.5

[56] References Cited

U.S. PATENT DOCUMENTS

| | | | |
|---|---|---|---|
| 1,142,125 | 6/1915 | Sooy | 405/50 X |
| 1,286,666 | 12/1918 | Layne | 405/50 X |
| 1,878,295 | 9/1932 | Richmond | 405/36 |
| 1,888,282 | 11/1932 | Miller | 405/238 |
| 2,126,575 | 8/1938 | Ranney | 405/36 X |
| 2,622,683 | 12/1952 | Silitch et al. | 405/36 X |
| 3,017,722 | 1/1962 | Smith | 52/169.5 |
| 3,336,755 | 8/1967 | Renfro | 405/50 |
| 3,426,487 | 2/1969 | Forte | 52/169.5 X |
| 4,045,964 | 9/1977 | Barclay | 405/50 |

*Primary Examiner*—Dennis L. Taylor

*Attorney, Agent, or Firm*—James C. Nemmers; Haven E. Simmons

[57] ABSTRACT

A system for lowering the gravitational water level around below-grade structures by means of an exterior wet well and an electric pump lift. The system utilizes a well lined with a water impervious material that has a plurality of openings at its lower end. A submersible pump is located at the bottom of the well which pump is operated by a level control device to maintain the water level at the bottom of the well at a predetermined height. The predetermined level is below the lowest level of the structure that is to be dewatered thereby lowering the water level and relieving water pressure around the structure.

4 Claims, 2 Drawing Figures

BASEMENT DEWATERING SYSTEM

BACKGROUND OF THE INVENTION

Any structure that is built below ground level may at times experience the problem of water entering the interior of the structure. Residential structures built with basements rarely escape this water problem. Generally, the problem is created because of subsurface water levels which create a tremendous amount of pressure thus forcing water into the below-grade structure even through minute cracks. Everyone who has lived in a home with a basement has at one time or another experienced this problem.

Many solutions to this water problem have been attempted in an effort to keep the interior of below-grade structures completely dry. For example, various compounds have been applied to the exterior surfaces of the below-grade structure in an effort to seal the structure and make it "waterproof". Where this is not possible or economical, attempts have been made to seal the interior of the below-grade structure by applying various compounds to the interior surfaces of the structure. Attempts to seal the below-grade structure either exteriorly or interiorly have not been successful. Other solutions have been to lay tile around the exterior of the subsurface walls in order to carry the water away from the structure. This procedure has been successful in some instances, but is relatively expensive especially when the tiling is not done at the time of initial construction of the below-grade structure. Attempts to relieve the water pressure by drilling holes in the floor inside of the below-grade walls have been somewhat successful, but such a procedure is illegal in many communities because the water drains into the sanitary sewer. This procedure has the obvious disadvantage that the floor of the basement or other structure will periodically become wet and therefore cannot be carpeted or used for any purpose where moisture will cause damage.

The problem of keeping basements and other below-grade structures dry is widespread, and no solution has ever been found that is economically feasible. There is therefore a tremendous need for a solution to this widespread problem.

BRIEF SUMMARY OF THE INVENTION

The system of the invention relieves the water pressure on below-grade structures by lowering the gravitational water level through the use of an exterior wet wall and a submersible pump which maintains the water level in the well at a level below the lowest level of the structure being dewatered. The system is constructed by drilling a vertical hole to form a well a few feet from an exterior wall of the below-grade structure. The well is drilled to a predetermined depth several feet below the lowest level of the below-grade structure and then lined with a water impervious material, such as plastic tubing, that has a plurality of openings in its lower end. A submersible pump is placed at the bottom of the well with the pump discharge connected to a pipe or tube leading away from the below-grade structure into a storm sewer or other place away from the structure. The submersible pump is operated by a water level control means so that the water level in the well is always at a level below the lowest level of the below-grade structure being dewatered. After the well has been in operation for a relatively short period of time, the subsurface water level in the area around the below-grade structure will be lowered to a level below the structure thus relieving the water pressure and keeping the interior of the structure completely dry.

DESCRIPTION OF THE PREFERRED EMBODIMENT OF THE INVENTION

Figure 1:
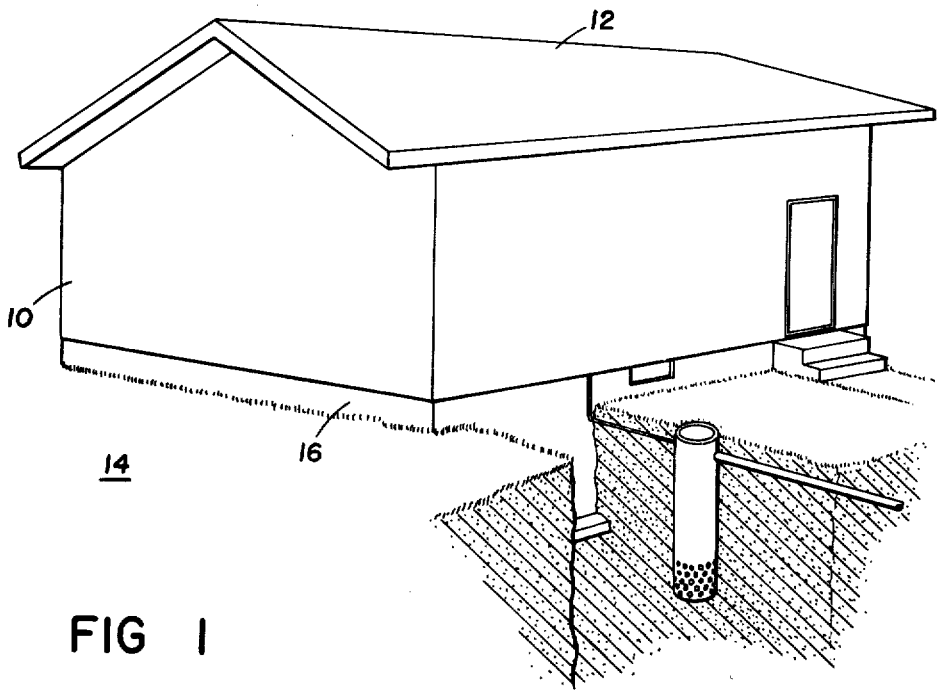
FIG. 1 is a perspective view of a structure a portion of which is below grade, with the ground being broken away to show the system of the invention.
Figure 2:
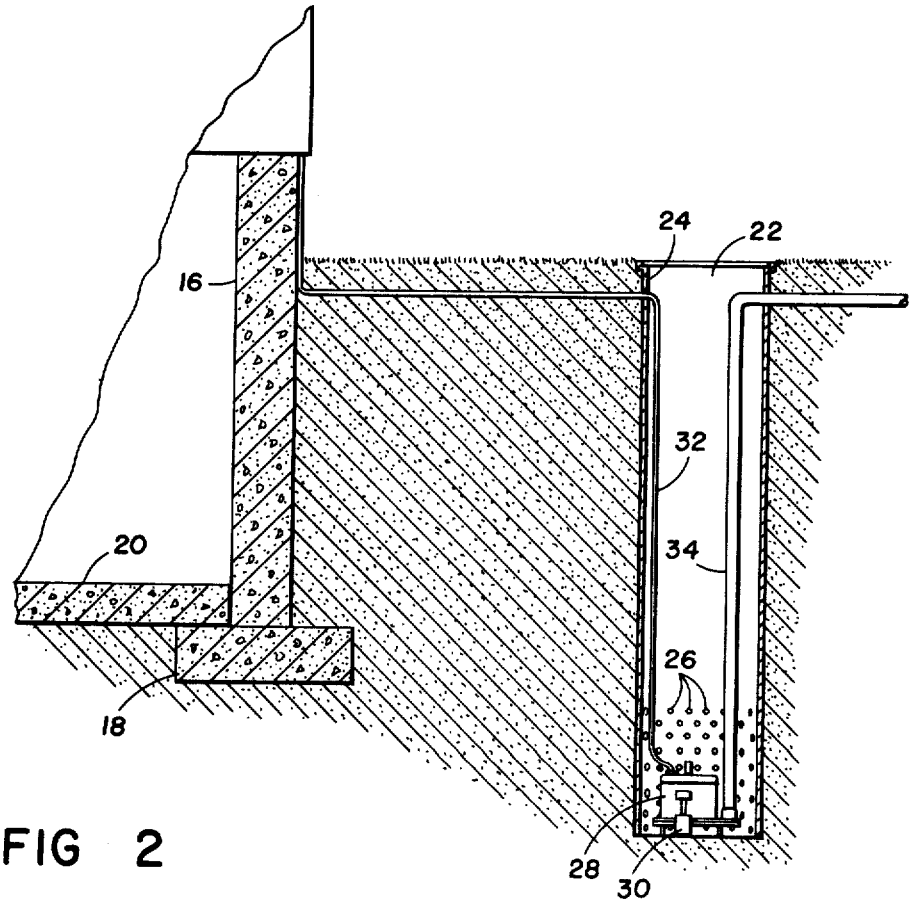
FIG. 2 is a sectional view through a portion of the below-grade structure and through the ground in the vicinity of the well thereby further illustrating the system of the invention.

In FIG. 1, for purposes of illustration, there is illustrated a small structure such as a single family residence which has a plurality of walls 10 covered by a roof 12. The walls 10 are above the level of the ground 14 and are thus above grade. The walls 10 are supported on vertical walls 16 the greatest portion of which are below grade. Walls 16 are generally constructed of poured concrete or concrete blocks and generally rest on footings 18 located below the frost line if the structure is constructed in an area where freezing temperatures frequently occur. Footings 18 also support, together with the ground 14, a floor 20 which generally is a poured concrete floor. The vertical walls 16 and floor 20 are commonly referred to as the "basement" of the structure.

The soil that forms the ground 14 generally contains moisture the amount of which varies depending upon the particular weather conditions in the area, the water table, and other factors. The gravitational water level around the structure will generally be such as to exert pressure on the vertical walls 16 and floor 20 of the structure. The amount of this pressure can become quite high thus forcing water through minute cracks in the walls 16 and floor 20 and through the joints where the floor 20 joins the walls 16. The system of the invention is designed to relieve the water pressure on the walls 16 and floor 20 by automatically keeping the gravitational water level below the level of the footings 18.

The system of the invention is installed by drilling a vertical opening or well 22 within a few feet from one of the vertical walls 16. The well 22 is drilled to a predetermined depth several feet below the footing 18 and floor 20. The depth of the well 22, its diameter and its distance from vertical wall 16 are determined according to the size of the basement or other area of the structure to be dewatered. For example, for a small structure, the well 22 may be about twelve inches in diameter and located within a few feet of one of the vertical walls 16. In some instances, more than one hole or well 22 must be drilled.

The vertical opening or well 22 is then lined with a water impervious material such as a piece of plastic tubing 24. Tubing 24 has a plurality of openings 26 formed at its lower end with the highest such opening formed below the lowest level of the structure to be dewatered. The holes 26 are preferably formed around the entire circumference of the tubing 24 at its lowest end. A submersible pump 28 of any suitable type is then placed at the bottom of the well. Pump 28 is of any suitable type of a standard manufacture that is operable by water level control means such as float 30. The pump 28 is preferably electrically operated by connection to a source of electrical power through a waterproof cord 32 that can be connected into the electrical system of the structure being dewatered.

The discharge end of the pump 28 is connected to a pipe or tube 34 which extends upwardly through the well 22 and then outwardly away from the structure to be dewatered. The discharge pipe 34 can be extended so that it discharges into a storm sewer or into a nearby street.

It has been found that when a well of the type described is constructed, the gravitational water in the area of the structure to be dewatered will tend to flow to the lowest level, this being the bottom of the well 22. The gravitational water in the area of the structure will in fact form its own veins in the subsurface soil which veins serve to carry the water to the well 22. When the water level in the well reaches a predetermined height, float 30 will start the pump 28 which will discharge water from the well until the water level again falls below a lower level also determined by float 30. Thus, the pump 28 will automatically keep the level of water in the well 22 at a predetermined low level below the basement floor 20 and footings 18. After the well has been constructed and in operation for a week or so, the gravitational water level in the area of the structure will automatically be maintained at the predetermined level so that all pressure on the vertical walls 16 and basement floor 20 will be relieved thus keeping the basement completely dry at all times.

From the foregoing description of the system of the invention, it will be evident that the system can be easily installed and used for existing structures. The well 22 can be drilled from above ground, the well liner 24 inserted in the drilled opening forming well 22, and then the submersible pump 28 lowered to the bottom of the well. The cord 32 can be buried a few inches below the ground as can the discharge pipe 34. All of this construction can take place from above ground level and be accomplished in a relatively short time with a minimum of labor. Thus, the invention provides a very simple, inexpensive and efficient way of maintaining a below-grade structure completely dry even in the wettest of areas and during the wettest season of the year for that area.

Although the invention has been described in connection with a preferred embodiment, it will be obvious to those skilled in the art that various revisions and modifications can be made in the preferred embodiment without departing from the spirit and scope of the invention. It is my intention however that all such revisions and modifications as are obvious to those skilled in the art will be included within the scope of the following claim.

I claim:

1. A drainage system for lowering the gravitational water level around a structure that is enclosed and extends below the ground, said system comprising means forming a vertical opening in the ground outside of and near said structure which opening extends from the surface of the ground to a level below the lowest level of said structure, said means including a lining of water-impervious material positioned inside of said vertical opening, said lining having a plurality of openings extending through it at its lower end to form a drainage access area extending below the lowest level of the structure, a submersible fluid pump located in said drainage access area at the lower end of said vertical opening, means responsive to the level of water in said vertical opening to start operation of said pump when said water level reaches a predetermined upper limit below the lowest level of the structure and to stop operation of said pump when said water level falls to a predetermined lower limit, and means connected to said pump to discharge water therefrom during the operation of the pump, said water being discharged at a substantial distance away from said structure.

2. The drainage system of claim 1 in which the means discharging the water from the pump is a discharge line having a first portion extending upwardly inside said vertical opening to a point near the top of said opening, said discharge line including a second portion connected to the first vertically extending portion and extending away from said structure and terminating at a point that is a substantial distance from said structure.

3. The drainage system of claim 1 in which said lining is a one-piece tube formed of relatively thin, corrosion-resistant and water-impervious rigid material, said lining being sufficiently rigid to provide for its insertion in said vertical opening by a person at ground level.

4. The drainage system of claims 1, 2 or 3 in which said drainage access area is entirely below the lowest level of said structure.

* * * * *